US008373729B2

(12) United States Patent
Lee et al.

(10) Patent No.: US 8,373,729 B2
(45) Date of Patent: Feb. 12, 2013

(54) KICKBACK COMPENSATION TECHNIQUES

(75) Inventors: Yongman Lee, Pleasanton, CA (US); Hopil Bae, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 397 days.

(21) Appl. No.: 12/833,761

(22) Filed: Jul. 9, 2010

(65) Prior Publication Data

US 2011/0227955 A1 Sep. 22, 2011

Related U.S. Application Data

(60) Provisional application No. 61/316,210, filed on Mar. 22, 2010.

(51) Int. Cl.
*G09G 5/10* (2006.01)

(52) U.S. Cl. ..... 345/690; 345/87; 345/89; 345/204; 345/214; 349/56; 349/84; 349/85

(58) Field of Classification Search ..... 345/87, 345/89–95, 204, 208–210; 349/84, 85, 56
See application file for complete search history.

(56) References Cited

U.S. PATENT DOCUMENTS

| | | | | |
|---|---|---|---|---|
| 8,044,900 | B2 * | 10/2011 | Kim et al. | 345/87 |
| 2004/0169627 | A1 * | 9/2004 | Hong | 345/89 |
| 2006/0066553 | A1 | 3/2006 | Deane | |
| 2007/0024560 | A1 * | 2/2007 | Kim et al. | 345/94 |
| 2007/0211006 | A1 * | 9/2007 | Lee et al. | 345/89 |
| 2007/0296658 | A1 * | 12/2007 | Kim | 345/87 |
| 2008/0231620 | A1 * | 9/2008 | Hector et al. | 345/208 |
| 2008/0266217 | A1 * | 10/2008 | Kim | 345/87 |
| 2008/0278470 | A1 * | 11/2008 | Im et al. | 345/211 |
| 2009/0167659 | A1 * | 7/2009 | Kim et al. | 345/89 |
| 2009/0237340 | A1 * | 9/2009 | Park et al. | 345/90 |
| 2010/0053056 | A1 * | 3/2010 | Lee et al. | 345/94 |
| 2010/0128028 | A1 * | 5/2010 | Lee et al. | 345/214 |

FOREIGN PATENT DOCUMENTS

| | | |
|---|---|---|
| KR | 20030034869 | 5/2003 |
| KR | 20090074458 | 7/2009 |

* cited by examiner

*Primary Examiner* — Lun-Yi Lao
*Assistant Examiner* — Priyank Shah
(74) *Attorney, Agent, or Firm* — Fletcher Yoder PC

(57) ABSTRACT

A technique for reducing the kickback voltage error between two or more common voltage signal lines in a display device is provided. The kickback voltage error may be caused by driving a first and second common voltage at different levels. In one embodiment, a common voltage offset may be applied to the second common voltage such that the magnitude of the voltage kickback error is approximately equalized at the maximum and minimum pixel voltages for pixels coupled to the second common voltage. A data voltage offset, which may be determined based upon gray level data, may be applied to the data voltage supplied to the pixels coupled to the second common voltage. The foregoing technique may compensate for the kickback voltage error between the first and second common voltage lines, thereby reducing visual artifacts and improving color accuracy of the display.

18 Claims, 10 Drawing Sheets

KICKBACK COMPENSATION TECHNIQUES

CROSS-REFERENCE TO RELATED APPLICATIONS

This application claims the benefit of U.S. Provisional Patent Application No. 61/316,210, entitled "Kickback Compensation Techniques," filed Mar. 22, 2010, which is herein incorporated by reference.

BACKGROUND

The present disclosure relates generally to display devices and, more particularly, to liquid crystal display (LCD) devices.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including such consumer electronics as televisions, computers, and handheld devices (e.g., cellular telephones, audio and video players, gaming systems, and so forth). Such LCD devices typically provide a flat display in a relatively thin package that is suitable for use in a variety of electronic goods. In addition, such LCD devices typically use less power than comparable display technologies, making them suitable for use in battery powered devices or in other contexts were it is desirable to minimize power usage. LCD devices typically include a plurality of unit pixels arranged in a matrix. The unit pixels may be driven by scanning line and data line circuitry to display an image that may be perceived by a user.

LCD devices typically include thousands (or millions) of picture elements, i.e., pixels, arranged in rows and columns. For any given pixel of an LCD device, the amount of light that is viewable on the LCD depends on the voltage applied to the pixel. Typically, LCDs include driving circuitry for converting digital image data into analog voltage values which may be supplied to pixels within a display panel of the LCD. An electrical field is generated by a voltage difference between a pixel electrode and a common electrode, which may align liquid crystals molecules within an adjacent liquid crystal layer to modulate light transmission through the LCD panel. In some displays, the kickback voltage behavior across certain pixels may not behave in the same way, thus resulting in a kickback voltage error between these pixels. This may cause visual artifacts to appear on the display, and may also reduce color accuracy of the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to display devices in which multiple common voltage signals are provided to an array of pixels. In such display devices, an array of pixels may include a first group of pixels coupled to a first common voltage and a second group of pixels coupled to a second common voltage. When the first and second common voltages are driven at different levels, there may be an error between the kickback voltage associated with each of the first and second common voltage lines, which may affect color accuracy of the display and may also cause visual artifacts. To compensate for this kickback voltage error, a first offset may be applied to the second common voltage, and a second offset may be applied to the data voltage supplied to one or more pixels coupled to the second common voltage. In certain embodiments, the second offset may be determined based upon the gray level of the digital image data provided to the pixel(s) coupled to the second common voltage. This technique may compensate for the kickback voltage error between the first and second common voltage lines, thereby reducing visual artifacts and improving color accuracy of the display.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
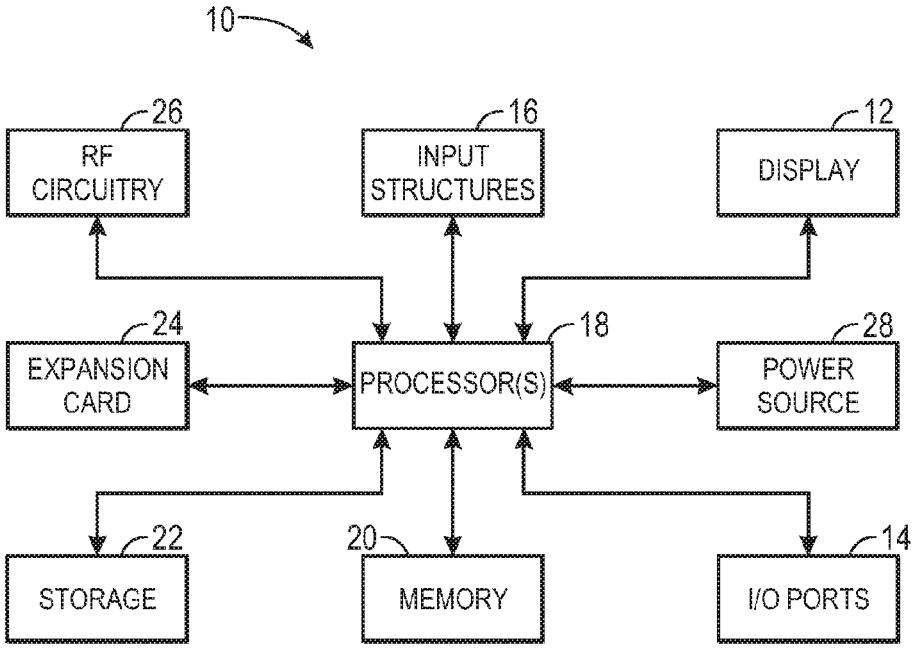
FIG. 1 is a block diagram of exemplary components of an electronic device that includes a display device, in accordance with aspects of the present disclosure.

One or more specific embodiments will be described below. These described embodiments are provided only by way of example, and do not limit the scope of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments described below, the articles "a," "an," and "the" are intended to mean that there are one or more of the elements. The terms "comprising," "including," and "having" are intended to be inclusive and mean that there may be additional elements other than the listed elements. Moreover, while the term "exemplary" may be used herein in connection to certain examples of aspects or embodiments of the presently disclosed subject matter, it will be appreciated that these examples are illustrative in nature and that the term "exemplary" is not used herein to denote any preference or requirement with respect to a disclosed aspect or embodiment. Additionally, it should be understood that references to "one embodiment," "an embodiment," "some embodiments," and the like are not intended to be interpreted as excluding the existence of additional embodiments that also incorporate the disclosed features.

As will be discussed below, the present disclosure is relates generally to display devices having two or more common voltage signals. In such display devices, an array of pixels may include a first group of pixels coupled to a first common voltage and a second group of pixels coupled to a second common voltage. When the first and second common voltages are set at different values, an error may be present between the kickback voltage associated with each of the first and second common voltage lines. This may undesirably affect color accuracy of the display and may also cause visual artifacts. To compensate for this kickback voltage error, a first offset may be applied to the second common voltage, and a second offset may be applied to the data voltage supplied to one or more pixels coupled to the second common voltage. In certain embodiments, the second offset may be determined based upon the gray level of the digital image data provided to the pixel(s) coupled to the second common voltage. This technique may compensate for the kickback voltage error between the first and second common voltage lines, thereby reducing visual artifacts and improving color accuracy of the display.

Figure 2:
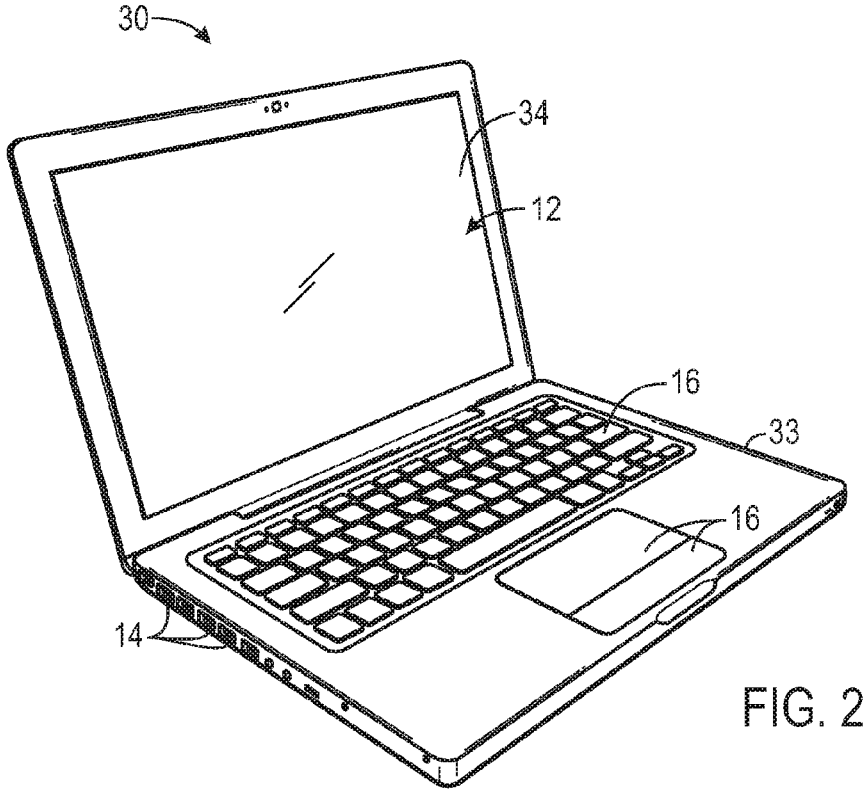
FIG. 2 is a perspective view of an electronic device in the form of a computer, in accordance with aspects of the present disclosure.
Figure 3:
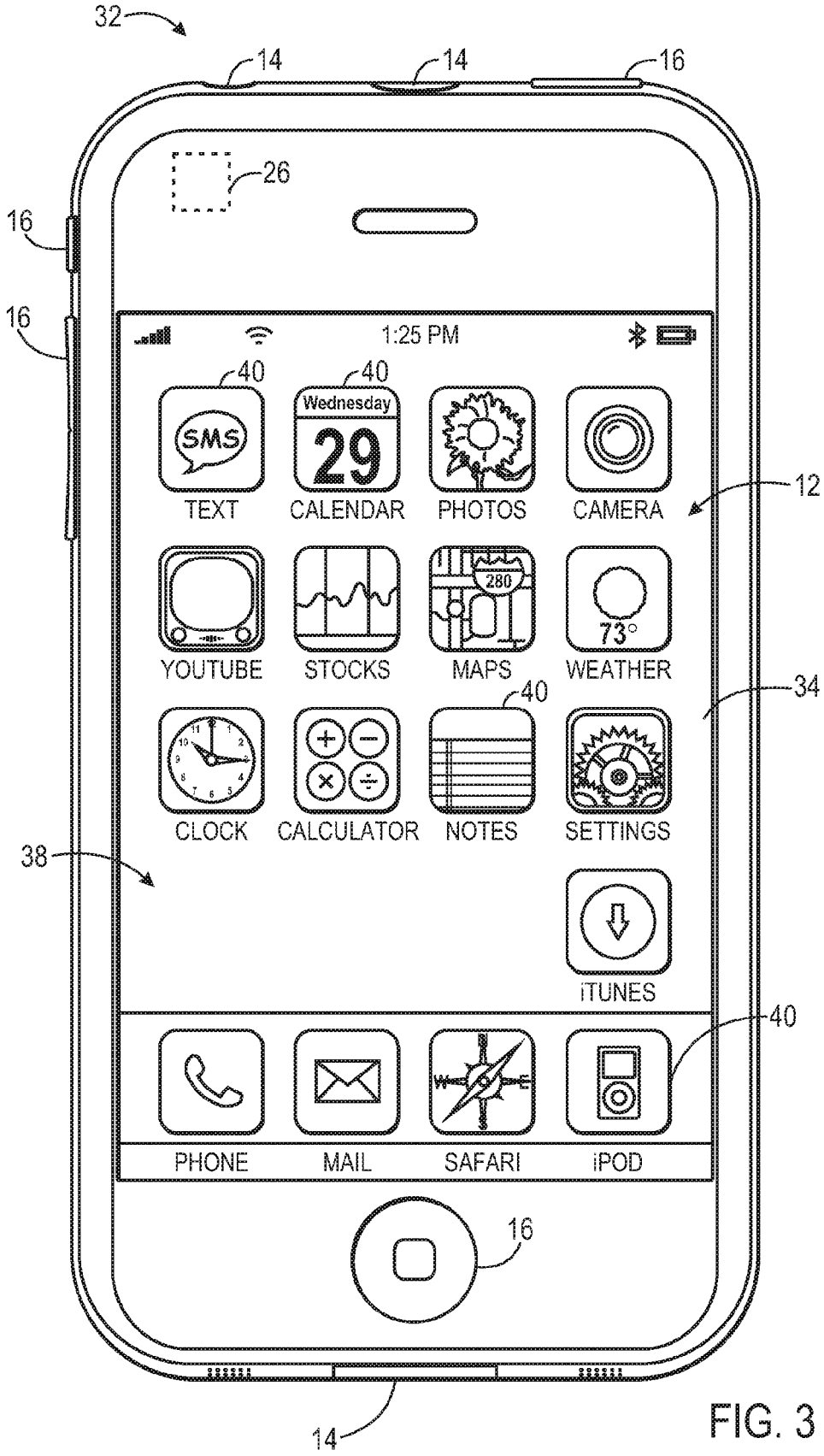
FIG. 3 is a front-view of a portable handheld electronic device, in accordance with aspects of the present disclosure.
Figure 4:
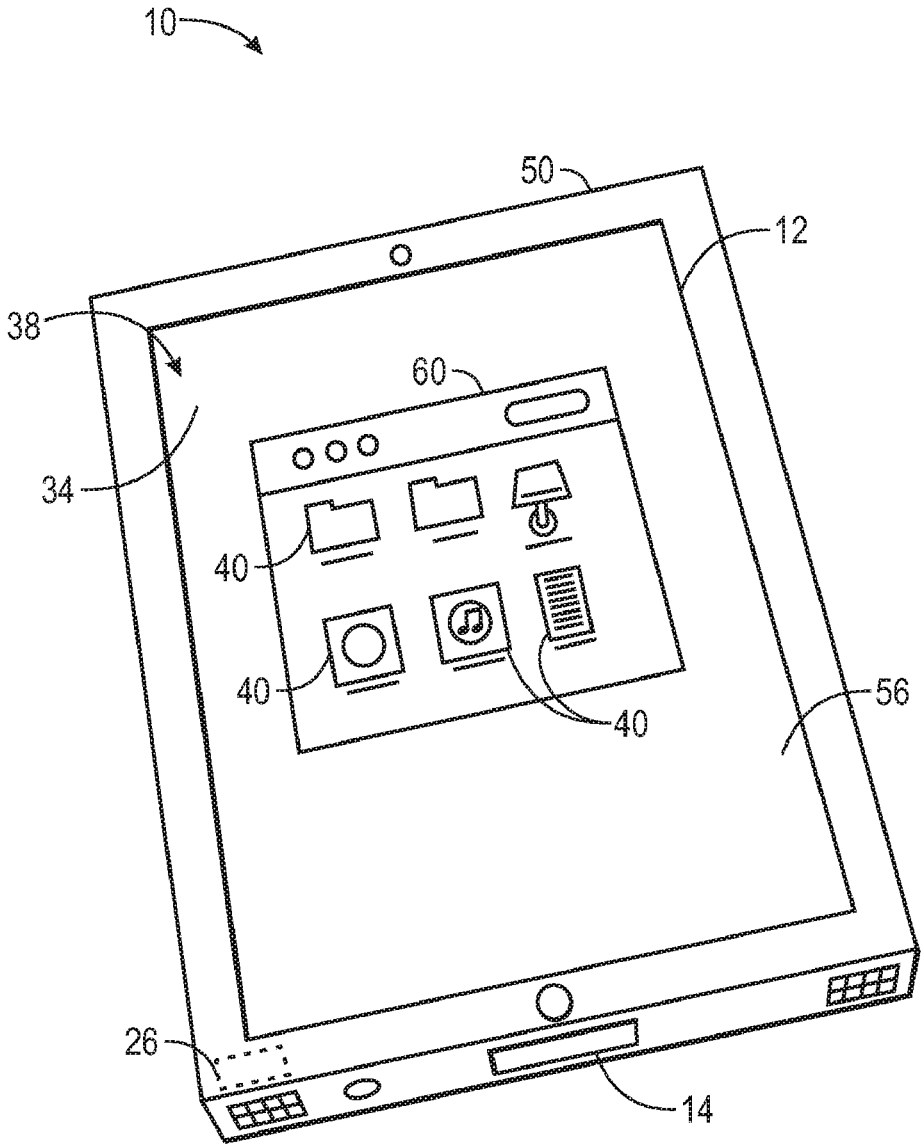
FIG. 4 is a perspective view of a tablet-style electronic device that may be used in conjunction with aspects of the present disclosure.

With the foregoing in mind, a general description of suitable electronic devices for performing these functions is provided below with respect to FIGS. 1-4. Specifically, FIG. 1 is a block diagram depicting various components that may be present in electronic devices suitable for use with the present techniques is provided. FIG. 2 depicts an example of a suitable electronic device in the form of a computer. FIG. 3 depicts another example of a suitable electronic device in the form of a handheld portable electronic device. Additionally, FIG. 4 depicts yet another example of a suitable electronic device in the form of a computing device having a tablet-style form factor. These types of electronic devices, as well as other electronic devices providing comparable display capabilities, may be used in conjunction with the present techniques.

Keeping the above points in mind, FIG. 1 is a block diagram illustrating components that may be present in one such electronic device 10, and which may allow the device 10 to function in accordance with the techniques discussed herein. The various functional blocks shown in FIG. 1 may include hardware elements (including circuitry), software elements (including computer code stored on a computer-readable medium, such as a hard drive or system memory), or a combination of both hardware and software elements. It should be noted that FIG. 1 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

The display 12 may be used to display various images generated by the electronic device 10. The display may be any suitable display such as a liquid crystal display (LCD), a plasma display, or an organic light emitting diode (OLED) display, for example. In one embodiment, the display 12 may be an LCD employing fringe field switching (FFS), in-plane switching (IPS), or other techniques useful in operating such LCD devices. The display 12 may be a color display utilizing a plurality of color channels for generating color images. By way of example, the display 12 may utilize a red, green, and blue color channel. The display 12 may include gamma adjustment circuitry configured to convert digital levels (e.g., gray levels) into analog voltage data in accordance with a target gamma curve. By way of example, such conversion may be facilitated using a digital-to-analog converter, which may include one or more resistor strings, to produce "gamma-corrected" data voltages.

In certain embodiments, the display 12 may include an arrangement of unit pixels defining rows and columns that form an image viewable region of the display 12. A source driver circuit may output this voltage data to the display 12 by way of source lines defining each column of the display 12. Each unit pixel may include a thin film transistor (TFT) configured to switch a pixel electrode. A liquid crystal capacitor may be formed between the pixel electrode and a common electrode, which may be coupled to a common voltage line ($V_{COM}$). When activated, the TFT may store image signals received via a respective data or source line as a charge in the pixel electrode. The image signals stored by the pixel electrode may be used to generate an electrical field between the respective pixel electrode and a common electrode. Such an electrical field may align liquid crystals molecules within an adjacent liquid crystal layer to modulate light transmission through the liquid crystal layer.

As will be discussed further below, embodiments of the present technique may reduce and/or compensate for errors that may be present between the kickback voltages associated with multiple common voltages ($V_{COM}$) in a display panel. Such a display panel may sometimes be referred to as a "split $V_{COM}$" display. For instance, when the common voltage lines corresponding each of the common voltages are driven at different levels, visual artifacts and/or color inaccuracies may result. This problem may be exacerbated when pixels tied to different respective common voltages are subject to different parasitic capacitances, which may be due at least partially to the different common voltages. By reducing the error between the kickback voltages associated with each of these common voltages, the appearance of visual artifacts due to such kickback voltage errors may be reduced and/or the color accuracy of the display panel may be improved.

In one embodiment, a display panel having multiple common voltages may be a display panel that utilizes an inversion driving method, such as line inversion, column inversion, or dot inversion. In other embodiments, a display panel that utilizes multiple common voltages may be a display panel that includes an integrally-formed touch sensing system. For instance, capacitive elements forming the pixels of such a display panel may function dually as capacitive elements for detecting touch inputs. In one implementation, two or more common voltages may be supplied to respective common voltage lines coupled to respective sets of pixels to define discrete regions within the touch sensing system. By way of example only, such regions may include a drive region that is stimulated by stimulation signals and a sense region that receives sense signals corresponding to the stimulation signals. In such an implementation, a first common voltage line may be referred to as the "stimulus" line and a second common voltage line may be referred to as a "sense" line. An example of a display device that may utilize two or more common voltages to provide for the above-discussed touch sensing functions is generally disclosed in the co-pending and commonly assigned U.S. patent application Ser. No. 12/240,964, entitled "Display With Dual-Function Capacitive Elements" filed Sep. 29, 2008, the entirety of which is hereby incorporated by reference for all purposes.

Such a touch sensing system may be provided in conjunction with the display 12 and may be commonly referred to as a touchscreen. The touchscreen that may be used as part of a control interface for the device 10. In such embodiments, the touchscreen may be formed integrally with the display 12 as one of the input structures 16. For instance, as discussed above, certain capacitive elements forming the pixels of the display 12 may dually function as pixel storage capacitors or as capacitive elements of a touch sensing system for detecting touch inputs. In this manner, a user may interact with the device by touching the display 12, such as by way of the user's finger or a stylus. By way of example only, such a touchscreen may include a self-capacitance touchscreen, a mutual-capacitance touchscreen, or any other suitable type of touchscreen system.

FIG. 2 illustrates an embodiment of the electronic device 10 in the form of a computer 30. The computer 30 may include computers that are generally portable (such as laptop, notebook, tablet, and handheld computers), as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® Mini, or Mac Pro®, available from Apple Inc. of Cupertino, Calif. The depicted computer 30 includes a housing or enclosure 33, the display 12 (e.g., as an LCD 34 or some other suitable display), I/O ports 14, and input structures 16.

The display 12 may be integrated with the computer 30 (e.g., such as the display of a laptop computer) or may be a standalone display that interfaces with the computer 30 using one of the I/O ports 14, such as via a DisplayPort, DVI, High-Definition Multimedia Interface (HDMI), or analog (D-sub) interface. For instance, in certain embodiments, such a standalone display 12 may be a model of an Apple Cinema Display®, available from Apple Inc. As will be discussed below, the display 12 may include two or more common voltage lines and may be configured to reduce and/or compensate for errors that may be present between the kickback voltage associated with each of the two or more common voltage lines, thereby reducing the appearance of visual artifacts and/or improving color accuracy.

The electronic device 10 may also take the form of other types of devices, such as mobile telephones, media players, personal data organizers, handheld game platforms, cameras, and/or combinations of such devices. For instance, as generally depicted in FIG. 3, the device 10 may be provided in the form of a handheld electronic device 32 that includes various functionalities (such as the ability to take pictures, make telephone calls, access the Internet, communicate via email, record audio and/or video, listen to music, play games, connect to wireless networks, and so forth). By way of example, the handheld device 32 may be a model of an iPod®, iPod® Touch, or iPhone® available from Apple Inc.

In the depicted embodiment, the handheld device 32 includes the display 12, which may be in the form of an LCD 34. The LCD 34 may display various images generated by the handheld device 32, such as a graphical user interface (GUI) 38 having one or more icons 40. As will be discussed below, the display 12/LCD 34 may include two or more common voltage lines and may further include driving logic configured to compensate for errors that may be present between the kickback voltage associated with each of the two or more common voltage lines of the display 12/LCD 34.

In another embodiment, the electronic device 10 may also be provided in the form of a portable multi-function tablet computing device 50, as depicted in FIG. 4. In certain embodiments, the tablet computing device 50 may provide the functionality of two or more of a media player, a web browser, a cellular phone, a gaming platform, a personal data organizer, and so forth. By way of example only, the tablet computing device 50 may be a model of an iPad® tablet computer, available from Apple Inc.

The tablet device 50 includes the display 12 in the form of an LCD 34 that may be used to display GUI 38. The GUI 38 may include graphical elements that represent applications and functions of the tablet device 50. For instance, the GUI 38 may include various layers, windows 60, screens, templates, or other graphical elements that may be displayed in all, or a portion, of the display 12. As shown in FIG. 4, the LCD 34 may include a touch-sensing system 56 (e.g., a touchscreen) that allows a user to interact with the tablet device 50 and the GUI 38. By way of example only, the operating system GUI 38 displayed in FIG. 4 may be from a version of the Mac OS® (e.g., OS X) operating system, available from Apple Inc.

Figure 5:
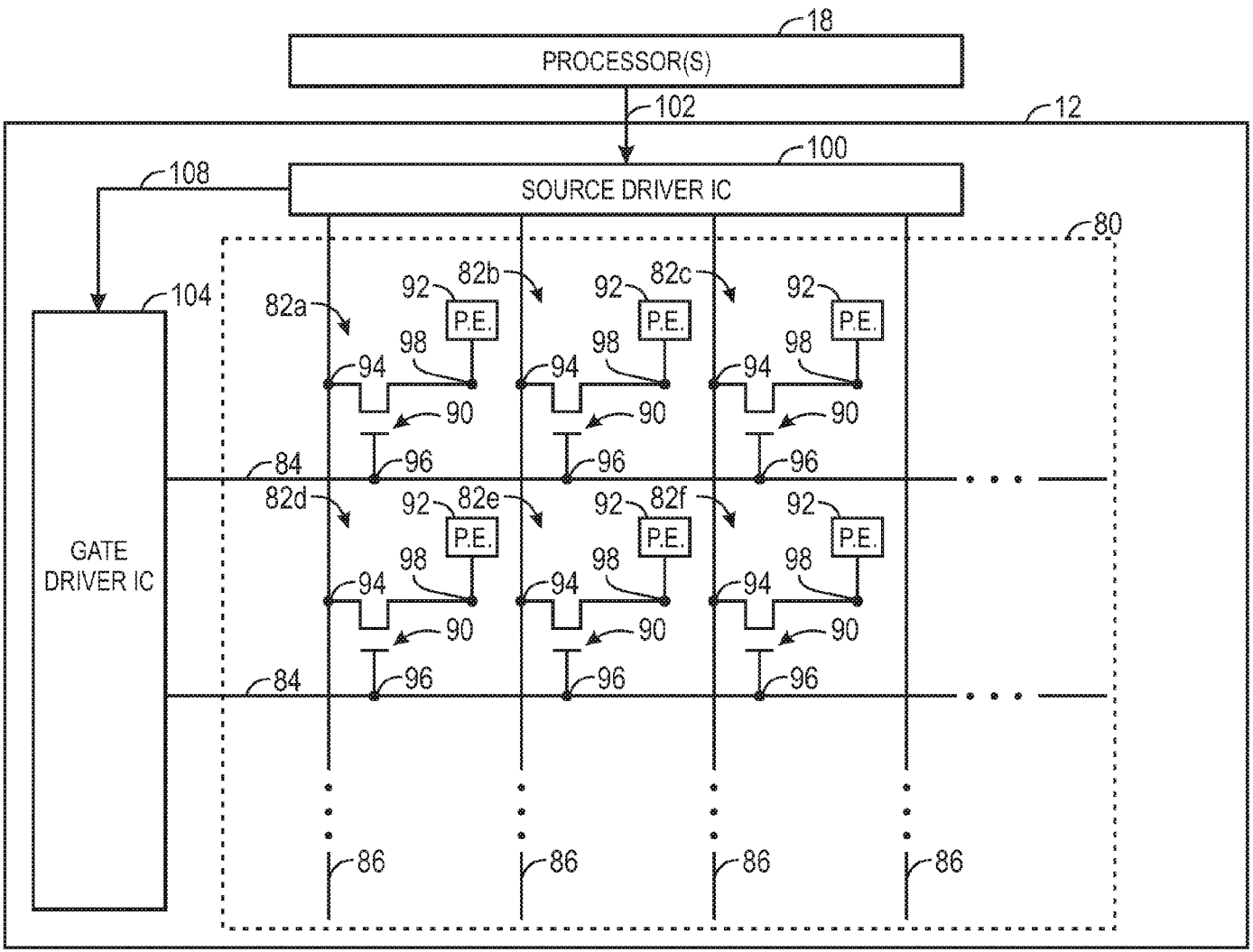
FIG. 5 is a circuit diagram illustrating the structure of unit pixels that may be provided in the display device of FIG. 1, in accordance with aspects of the present disclosure.

Referring now to FIG. 5, a circuit diagram of the display 12 is illustrated, in accordance with an embodiment. As shown, the display 12 may include a display panel 80, such as a liquid crystal display panel (e.g., LCD 34 of FIG. 2). The display panel 80 may include multiple unit pixels 82 disposed in a pixel array or matrix defining multiple rows and columns of unit pixels that collectively form an image viewable region of the display 12. In such an array, each unit pixel 82 may be defined by the intersection of rows and columns, represented here by the illustrated gate lines 84 (also referred to as "scanning lines") and source lines 86 (also referred to as "data lines"), respectively.

Although only six unit pixels, referred to individually by the reference numbers 82*a*-82*f*, respectively, are shown for purposes of simplicity, it should be understood that in an actual implementation, each source line 86 and gate line 84 may include hundreds or even thousands of such unit pixels 82. By way of example, in a color display panel 80 having a display resolution of 1024×768, each source line 86, which may define a column of the pixel array, may include 768 unit pixels, while each gate line 84, which may define a row of the pixel array, may include 1024 groups of unit pixels, wherein each group includes a red, blue, and green pixel, thus totaling 3072 unit pixels per gate line 84. By way of further example, the panel 80 may have a display resolution of 480×320 or, alternatively, 960×640. As will be appreciated, in the context of LCDs, the color of a particular unit pixel generally depends on a particular color filter that is disposed over a liquid crystal layer of the unit pixel. In the presently illustrated example, the group of unit pixels 82*a*-82*c* may represent a group of pixels having a red pixel (82*a*), a blue pixel (82*b*), and a green pixel (82*c*). The group of unit pixels 82*d*-82*f* may be arranged in a similar manner.

As shown in the present embodiment, each unit pixel 82*a*-82*f* includes a thin film transistor (TFT) 90 for switching a respective pixel electrode 92. In the depicted embodiment, the source 94 of each TFT 90 may be electrically connected to a source line 86. Similarly, the gate 96 of each TFT 90 may be electrically connected to a gate line 84. Furthermore, the drain 98 of each TFT 90 may be electrically connected to a respective pixel electrode 92. Each TFT 90 serves as a switching element which may be activated and deactivated (e.g., turned on and off) for a predetermined period based upon the respective presence or absence of a scanning signal at the gate 96 of the TFT 90. For instance, when activated, the TFT 90 may store the image signals received via a respective source line 86 as a charge in its corresponding pixel electrode 92. The image signals stored by pixel electrode 92 may be used to generate an electrical field between the respective pixel electrode 92 and a common electrode (not shown in FIG. 5). As discussed above, the pixel electrode 92 and the common electrode may form a liquid crystal capacitor for a given unit pixel 82. Thus, in an LCD panel 80, such an electrical field may align liquid crystals molecules within a liquid crystal layer to modulate light transmission through a region of the liquid crystal layer that corresponds to the unit pixel 82. For instance, light is typically transmitted through the unit pixel 82 at an intensity corresponding to the applied voltage (e.g., from a corresponding source line 86).

The display 12 also includes a source driver integrated circuit (source driver IC) 100, which may include a chip, such as a processor or ASIC, that is configured to control various aspects of display 12 and panel 80. For example, the source driver IC 100 may receive image data 102 from the processor (s) 18 and send corresponding image signals to the unit pixels 82 of the panel 80. The source driver IC 100 may also be coupled to a gate driver IC 104, which may be configured to activate or deactivate rows of unit pixels 82 via the gate lines 84. As such, the source driver IC 100 may send timing information, shown here by reference number 108, to gate driver IC 104 to facilitate activation/deactivation of individual rows of pixels 82. In other embodiments, timing information may be provided to the gate driver IC 104 in some other manner.

While the illustrated embodiment shows only a single source driver IC 100 coupled to panel 80 for purposes of simplicity, it should be appreciated that additional embodiments may utilize multiple source driver ICs 100 for providing image signals to the pixels 82. For example, additional embodiments may include multiple source driver ICs 100 disposed along one or more edges of the panel 80, wherein each source driver IC 100 is configured to control a subset of the source lines 86 and/or gate lines 84.

In operation, the source driver IC 100 receives image data 102 from the processor 18 or a discrete display controller and, based on the received data, outputs signals to control the pixels 82. For instance, to display image data 102, the source driver IC 100 may adjust the voltage of the pixel electrodes 92 (abbreviated in FIG. 2 as P.E.) one row at a time. To access an individual row of pixels 82, the gate driver IC 104 may send an activation signal to the TFTs 90 associated with the particular row of pixels 82 being addressed. This activation signal may render the TFTs 90 on the addressed row conductive. Accordingly, image data 102 corresponding to the addressed row may be transmitted from source driver IC 100 to each of the unit pixels 82 within the addressed row via respective data lines 86. Thereafter, the gate driver IC 104 may deactivate the TFTs 90 in the addressed row, thereby impeding the pixels 82 within that row from changing state until the next time they are addressed. The above-described process may be repeated for each row of pixels 82 in the panel 80 to reproduce image data 102 as a viewable image on the display 12.

Figure 6:
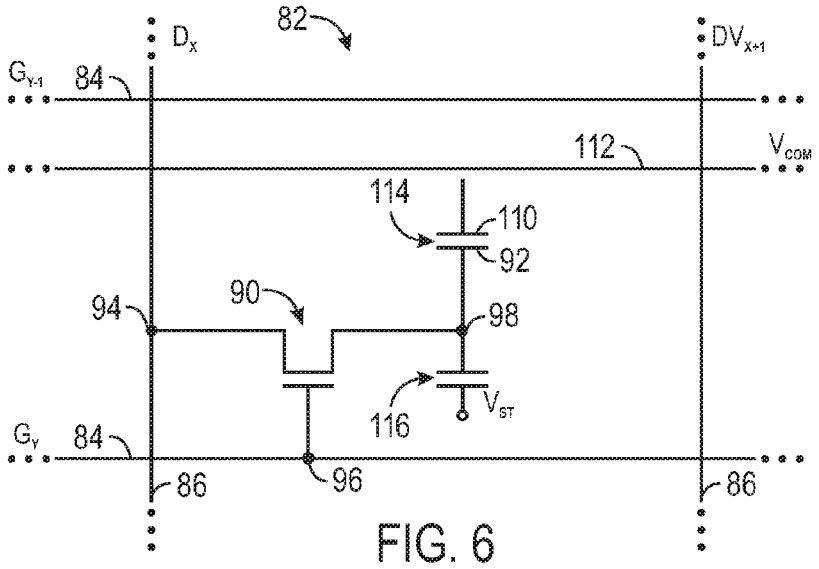
FIG. 6 is a circuit diagram depicting a single unit pixel, in accordance with aspects of the present disclosure.

Referring briefly to FIG. 6, a circuit diagram of an embodiment of a pixel 82 is illustrated in greater detail. As shown, the TFT 90 is coupled to the source line 86 ($D_x$) and the gate line 84 ($G_y$). The pixel electrode 92 and the common electrode 110 may form a liquid crystal capacitor 114. The common electrode 110 is coupled to a common voltage line 112 that supplies the common voltage $V_{COM}$. The $V_{COM}$ line 112 may be formed parallel to the gate lines 84 or, in other embodiments, parallel to the source lines 86. As will be discussed further below, the panel 80, in accordance with the present techniques, may utilize multiple $V_{COM}$ voltages (e.g., $V_{COM1}$ and $V_{COM2}$) and may, therefore, include multiple $V_{COM}$ lines 112 for providing each of the $V_{COM}$ voltages to respective pixels 82.

In the present embodiment, the pixel 82 also includes a storage capacitor 116 having a first electrode coupled to the drain 98 of the TFT 90 and a second electrode coupled to a storage electrode line that supplies the voltage $V_{ST}$. In other embodiments, the second electrode of the storage capacitor 116 may be coupled instead to the previous gate line 84 (e.g., $G_{y-1}$) or to ground. As will be appreciated, the storage capacitor 116 may sustain the pixel electrode voltage during holding periods (e.g., until the next time the gate line 84 ($G_y$) is activated by the gate driver IC 104.

Referring back to FIG. 5, in sending image data to each of the pixels 82, a digital image is typically converted into numerical data so that it can be interpreted by a display device. For instance, the image 102 may itself be divided into small "pixel" portions, each of which may correspond to a respective pixel 82 of the panel 80. In order to avoid confusion with the physical unit pixels 82 of the panel 80, the pixel portions of the image 102 shall be referred to herein as "image pixels." Each image pixel of the image 102 may be associated with a numerical value, which may be referred to as a "digital level" that quantifies the luminance intensity (e.g., brightness or darkness) of the image 102 at a particular spot. The digital level of each image pixel may represent a shade of darkness or brightness between black and white, commonly referred to as a "gray level."

The number of gray levels in an image usually depends on the number of bits used to represent pixel intensity levels in a display device, which may be expressed as $2^N$ gray levels, where N is the number of bits used to express a digital level. By way of example, in an embodiment where the display 12 is a normally black display using 10 bits to represent a digital level, the display 12 may be capable of providing 1024 gray levels (e.g., $2^{10}$) to display an image, wherein a digital level of 0 corresponds to full black (e.g., no transmittance), and a digital level of 1023 corresponds to full white (e.g., full transmittance). Similarly, if 8 bits are used to represent a digital level, then 256 gray levels (e.g., $2^8$) may be available for displaying an image. To provide an example, in one embodiment, the source driver IC 100 may receive an image data stream equivalent to 24 bits of data, with 8-bits of the image data stream corresponding to a digital level for each of the red, green, and blue color channels corresponding to a pixel group having each of a red, green, and blue unit pixel (e.g., 82*a*-82*c* or 82*d*-82*f*). Further, although digital levels corresponding to luminance are generally expressed in terms of gray levels, where a display utilizes multiple color channels (e.g., red, green, blue), the portion of the image corresponding to each color channel may be individually expressed as in terms of such gray levels. Accordingly, while the digital level data for each color channel may be interpreted as a grayscale image, when processed and displayed using unit pixels 82 of the panel 80, color filters (e.g., red, blue, and green) overlaying each unit pixel 32 allows the image to be perceived by a viewer as being a color image.

To convert gray level data to analog signals, a digital-to-analog converter is typically provided and is sometimes referred to as a gamma adjustment circuit or gamma voltage circuit. As will be appreciated, the luminance characteristics of viewable representations of digital image data displayed by a display device, such as the display 12, may not always be reproduced accurately (e.g., relative to "raw" image data 102) when perceived by the human eye viewing the display 12. Generally, such inaccuracies may be attributed at least partially to the digital-to-analog conversion of digital levels within source driver IC 100, a luminance transfer function associated with the display panel 80, and/or the non-linear response of the human eye, which generally perceives digital or gray levels in a non-linear manner with respect to luminance. Additionally, the various components making up the display 12, such as the source driver IC 100 and panel 80, may often be manufactured by different vendors. Thus, where the source driver IC 100 includes digital-to-analog conversion circuitry in the form of a resistor string, the resistor values selected by one vendor may not always match the requirements of a panel 80 produced by a different vendor, thus resulting in gamma inaccuracies.

Accordingly, a gamma adjustment circuit is generally responsible for converting the gray level data and compensating for such inaccuracies so that the human eye perceives the image data displayed on the panel 80 as having a generally linear relationship with regard to digital levels and perceived brightness. In some embodiments, gamma may be adjusted independently for each color channel (e.g., red, green, and blue).

Figure 7:
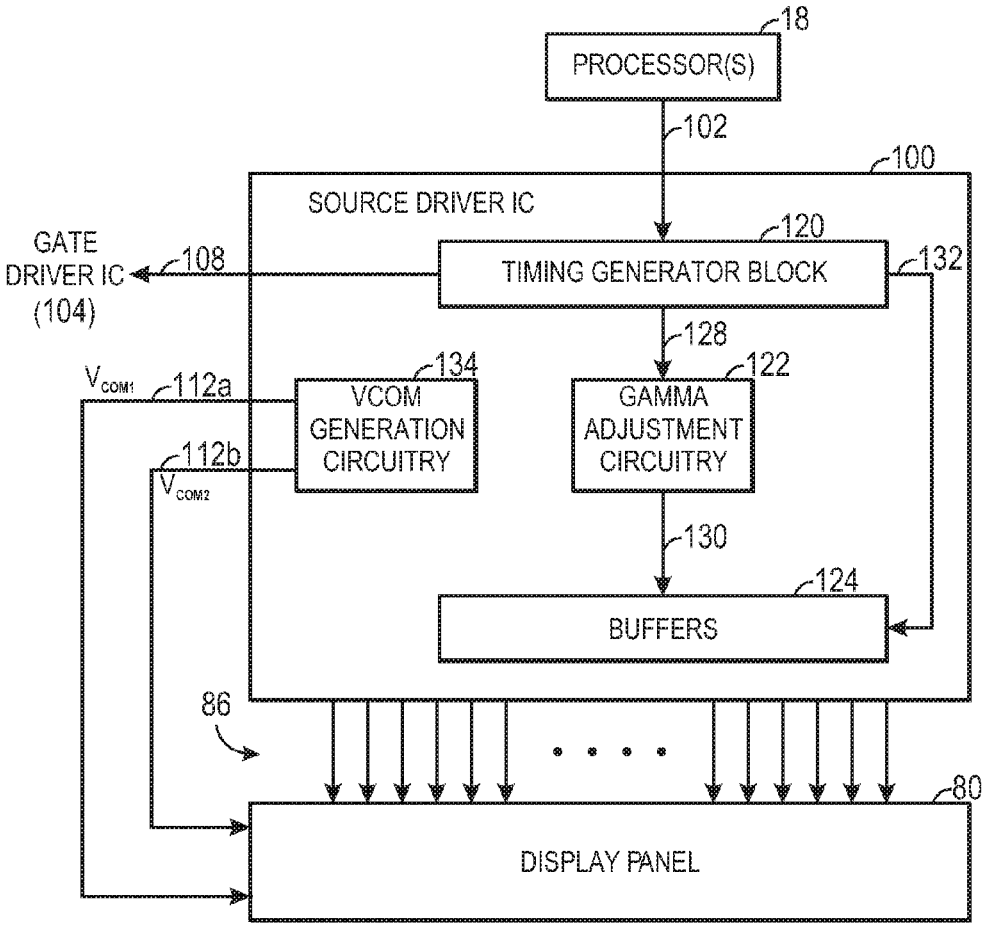
FIG. 7 is a block diagram showing a processor and an example of a source driver integrated circuit (IC) of FIG. 5, in accordance with aspects of the present disclosure.

Continuing to FIG. 7, a more detailed block diagram of the source driver IC 100 is illustrated. As shown, the source driver IC 100 may include various logic blocks for processing image data 102 received from the processor 18, including a timing generator block 120, gamma voltage circuitry 122, and one or more frame buffers 124. The timing generator block 120 may generate appropriate timing signals for controlling the source driver IC 100 and gate driver IC 104. For instance, the timing generator block 120 may control the transmission of image data 102 to the gamma voltage circuitry 122, frame buffers 124, and source lines 86. By way of example, timing generator block 120 may provide a portion 128 of the image data 102 to gamma voltage circuitry 122 in a timed manner. For instance, the portion 128 of image data 102 may represent image signals transmitted in line-sequence via a predetermined timing. The timing generator block 120 may additionally provide appropriate timing signals 108 to the gate driver IC 104, such that scanning signals along the gate lines 84 (FIG. 5) may be applied by line sequence with a predetermined timing and/or in a pulsed manner to appropriate rows of unit pixels 82.

As mentioned above, gamma correction or adjustment may be utilized to compensate for inaccuracies that occur in reproducing viewable representations of digital image data, such as those resulting from the non-linear human eye response and/or the digital-to-analog conversion of gray levels. Embodiments of the source driver IC 100 may provide a single gamma voltage circuit 122 that applies to all color channels, or may provide separate gamma voltage circuits to provide for the independent gamma adjustment of multiple color channels, such as a red, green, and blue channel.

In one embodiment, the gamma voltage circuit 122 may be a digital-to-analog converter that includes one or more resistor strings. For instance, the gamma voltage circuit 122 may include a first stage of resistors arranged in a string configuration (a resistor string) that may provide multiple voltages that may be selected as adjustment or tap voltages. The selected tap voltages may be provided to a second stage resistor string that is used to select the gamma voltages. For instance, the voltage adjustment or tap points may modify the voltage division ratios along the second resistor string, thereby modifying one or more of the gamma output voltage levels. The gamma voltage values may be supplied to a selection circuit, such as multiplexer, which selects the appropriate voltage based upon a corresponding gray level. As will be appreciated, the location of the tap points may be selected based upon transmittance sensitivities of a particular color channel to applied voltage levels. Further, while various embodiments disclosed herein pertain to displays having red, green, and blue channels (RGB), it should be appreciated that displays in additional embodiments may utilize other suitable color configurations, such as a four-channel red, green, blue, and white (RGBW) display, or a cyan, magenta, yellow, and black (CMYB) display. The frame buffer(s) 124 may receive data voltage signals representing "gamma-corrected" image data 130. The frame buffer 124, which may also receive timing signals 132 from the timing generator block 120, may output the gamma-corrected image data 130 to the display panel 80 by way of source lines 86.

The illustrated source driver IC 100 also includes $V_{COM}$ generation circuitry 134, which may be configured to provide a first common voltage ($V_{COM1}$) and a second common voltage ($V_{COM2}$) to the display panel 80 by way of the common voltage lines 112*a* and 112*b*, respectively. As discussed above, a common voltage (e.g., $V_{COM1}$ or $V_{COM2}$) may be provided to the common electrode 110 of each pixel 82, while a data voltage (e.g., representing image data) is provided to the pixel electrode 92 (e.g., when the gate of its corresponding TFT 90 is active). Accordingly, an electrical field is generated by a voltage difference between the pixel electrode 92 and the common electrode 110, which may align liquid crystals molecules within an adjacent liquid crystal layer to modulate light transmission through the panel 80. Further, while shown as being integrated with the source driver IC 100, in other embodiments, the $V_{COM}$ circuitry 134, the gamma adjustment circuitry 122, as well as the timing generator 120, may be separate from the source driver IC 100.

The $V_{COM}$ circuitry 134 may include a digital-to-analog converter, such as a resistor string, for producing $V_{COM}$. In one embodiment, a common reference voltage (e.g., ground) may be provided by sharing a resistor string between the common voltage ($V_{COM}$) generation circuitry 134 and the gamma voltage circuitry 122. An example of a display that utilizes such a configuration is generally disclosed in the commonly assigned U.S. Provisional Patent Application Ser. No. 61/316,204, entitled "Gamma Resistor Sharing for VCOM Generation,", filed on Mar. 22, 2010, the entirety of which is hereby incorporated by reference for all purposes. Generally, $V_{COM}$ is provided at a level close to but not at 0 volts, such as at between approximately 0.1 to 0.5 volts, to compensate for parasitic capacitances within the panel 80. When the voltage at the gate 96 decreases (e.g., during row deactivation), $V_{COM}$ is generally raised to compensate for the gate voltage drop, which may prevent flickering. However, as discussed above, the use of two common voltages may result in an error between their respective corresponding kickback voltages, which may undesirably result in visual artifacts and/or reduced color accuracy.

Figure 8:
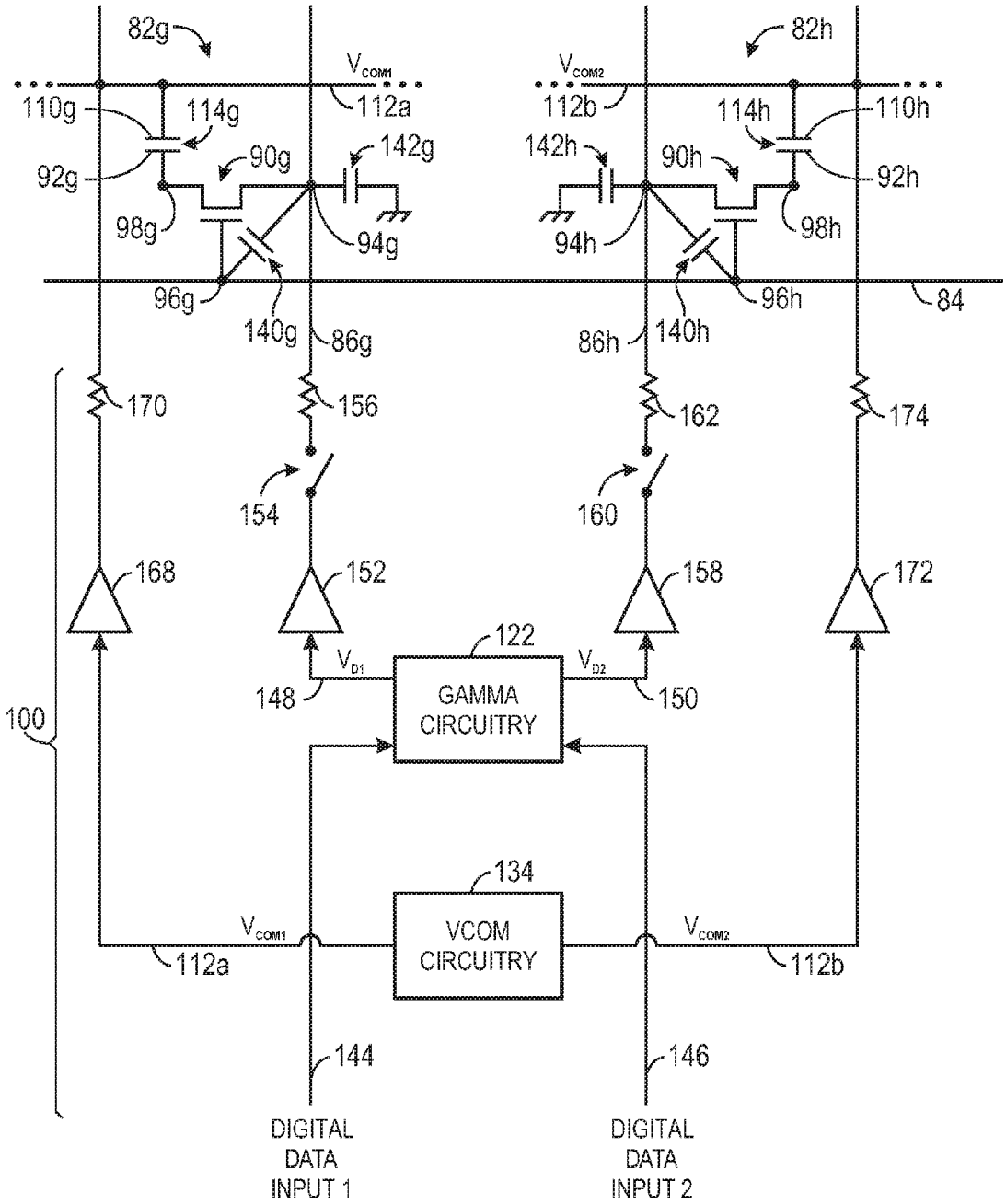
FIG. 8 is a schematic representation showing a configuration of a display panel that includes the source driver IC of FIG. 7, as well as first and second pixels coupled to first and second common voltages, respectively, in accordance with aspects of the present disclosure.

Referring now to FIG. 8, a schematic representation showing an embodiment of the display panel 80 that includes a first pixel 82*g* and a second pixel 82*h* coupled to a first common voltage ($V_{COM1}$) via the common voltage line 112*a* and a second common voltage ($V_{COM2}$) via the common voltage line 112*b*, respectively, is illustrated. Particularly, the $V_{COM1}$ line 112*a* may be coupled to the common electrode 110*g* of the pixel 82*g*, and the $V_{COM2}$ line 112*b* may be coupled to the common electrode 110*h* of the pixel 82*h*. The pixels 82*g* and 82*h* also include TFTs 90*g* and 90*h*, respectively, each having respective gates 96*g* and 96*h* coupled to the gate line 84.

FIG. 8 also depicts certain parasitic capacitances that may be present in each of the pixels 82*g* and 82*h*. For example, a parasitic capacitance 140*g* may be present between the gate 96*g* and the source 94*g* of the pixel 82*g*, and a parasitic capacitance 140*h* may be present between the gate 96*h* and the source 94*h* of the pixel 82*h*. Additionally, a parasitic capacitance 142*g* may be present between the source 94*g* of the pixel 82*g* and a voltage reference (e.g., ground), and a parasitic parasitic capacitance 142*h* may be present between the source 94*h* of the pixel 82*h* and the voltage reference. In one embodiment, driving $V_{COM1}$ and $V_{COM2}$ at different values may result in the capacitances 140*g-h* and 142*g-h* having different values. This may contribute to an error in the kickback voltage between the $V_{COM1}$ line 112*a* and the $V_{COM2}$ line 112*b*, as will be discussed further below.

Certain elements of the source driver IC 100 are also depicted in FIG. 8. For instance, the gamma voltage circuitry 122 is shown as receiving a first digital data input 144 that corresponds to the first pixel 82*g* and a second digital data input 146 that corresponds to a second pixel 82*h*. The inputs 144 and 146 may represent gray level date for the pixels 82*g* and 82*h*. As discussed above, the gamma voltage circuitry 122 may include digital-to-analog conversion circuitry, such as a resistor string, that may provide corresponding analog data voltages for each available gray level supported by the display panel 80. In the present embodiment, the gray level signals 144 and 146 may function as control or selection signals provided to a selection circuit, such as a multiplexer, for selecting the appropriate analog data voltages 148 ($V_{D1}$) and 150 ($V_{D2}$), respectively.

The analog data voltages 148 and 150 are then driven down their respective source lines 86*g* and 86*h* to the pixels 82*g* and 82*h*. For instance, as shown in FIG. 8, the source line 86*g* may include an amplifier 152, a switch 154, and a resistor 156, which may function collectively to drive the data voltage 148 to the source 94*g* of the pixel 82*g*. Similarly, the source line 86*h* may include an amplifier 158, a switch 160, and a resistor 162, which may function collectively to drive the data voltage 150 to the source 94*h* of the pixel 82*h*. Further, the $V_{COM}$ circuitry 134 may provide the common voltages $V_{COM1}$ and $V_{COM2}$ to the common voltage lines 112*a* and 112*b*, respectively. As shown in FIG. 8, the $V_{COM1}$ line 112*a* includes an amplifier 168 and resistor 170 for driving $V_{COM1}$ to to the pixel 82*g*, and the $V_{COM2}$ line 112*b* includes an amplifier 172 and a resistor 174 for driving $V_{COM2}$ to the pixel 82*h*.

During operation, the TFTs 90*g* and 90*h* are switched on when the gate line 84 is activated. This causes the data voltage 148 to be applied to the pixel electrode 92*g* and the data voltage 150 to be applied to the pixel electrode 92*h*. As discussed above, the voltage difference between the pixel electrode (e.g., 92*g*, 92*h*) and the common electrode (e.g., 110*g*, 110*h*), which may be referred to as the "pixel voltage," may generate an electrical field that aligns liquid crystal molecules within an adjacent liquid crystal layer to modulate light transmission through the display panel 80. Thus, in the present embodiment, the pixel voltage of the pixel 82*g* maybe expressed as $V_{D1}-V_{COM1}$, and the pixel voltage of the pixel 82*h* may be expressed as $V_{D2}-V_{COM2}$. As will be appreciated, if an electrical field generated between the pixel electrode 92*g*, 92*h* and the common electrode 110*g*, 110*h* is applied in the same direction continuously, this may degrade the liquid crystal material within display 12 over time. Thus to prevent degradation of the liquid crystal, the data voltages provided to the display may be driven by alternating their polarity, thereby causing the direction of the electric field to alternate. Such a driving method may be referred to as line inversion, column inversion, or dot inversion.

Figure 9:
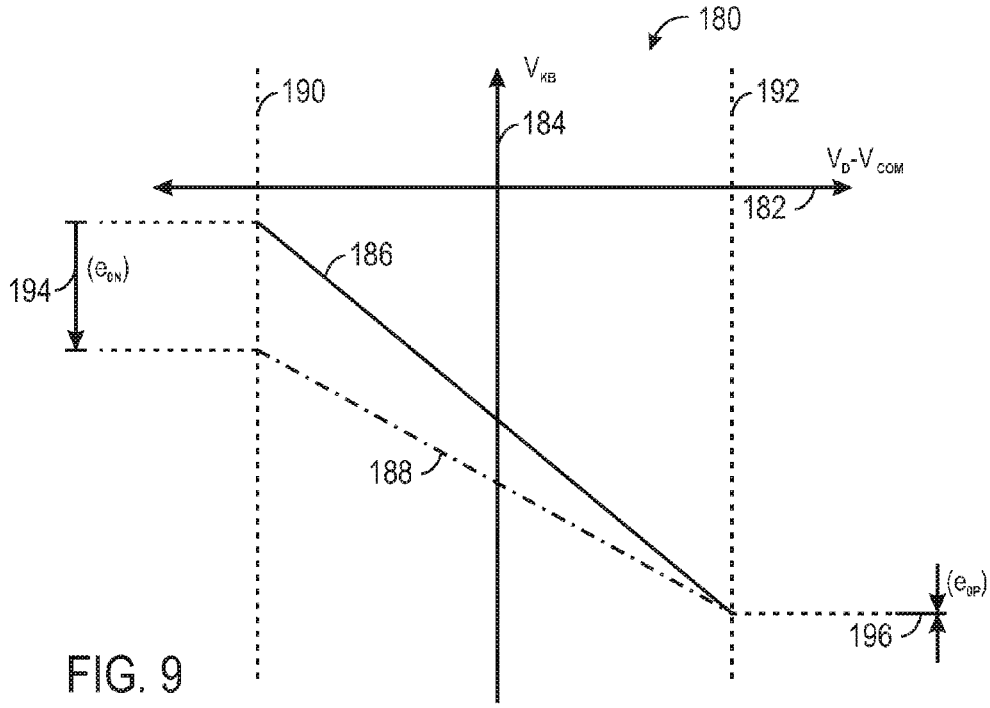
FIG. 9 is a graph illustrating an error which may be present between the kickback voltages associated with the first and second pixels of FIG. 8.

As discussed above, the use of two common voltages in a display panel may provide for the definition of discrete touch sensing regions for a touch-sensing system that is integrally formed with the display. However, this may result in an error between their respective corresponding kickback voltages and may cause visual artifacts and/or degrade color accuracy, particularly when the two common voltages are set at different levels. Referring to FIG. 9, a graph 180 depicting the kickback voltage error that may be present when $V_{COM1}$ and $V_{COM2}$ have different values is illustrated. The graph 180 includes a first axis 182 representing pixel voltage ($V_D-V_{COM}$) and a second axis 184 representing kickback voltage. The solid line 186 represents the kickback voltage for $V_{COM1}$ as a function of the pixel voltage, which may be expressed as $V_{D1}-V_{COM1}$, of the first pixel 82*g* of FIG. 8. Similarly, the dashed line 188 represents the kickback voltage for $V_{COM2}$ as a function of pixel voltage, which may be expressed as $V_{D2}-V_{COM2}$, of the second pixel 82*h* of FIG. 8.

The boundary lines 190 and 192 may represent negative and positive limits, respectively, for the pixel voltage. For instance, this may depend upon the positive and negative limits of the analog data voltages provided by the gamma circuitry 122 depending upon whether the image data is being driven positively or negatively (e.g., using an inversion method). By way of example only, in one embodiment, the data voltages may have a maximum positive value of 12 volts, and a minimum negative value of −6 volts, such that the voltage swing is asymmetrical about 0 volts. The voltage swing may also be symmetrical in other embodiments.

As shown in FIG. 9, when the pixel voltage ($V_D-V_{COM}$) is at the maximum 192 (e.g., $V_D$ is at its maximum positive level), the kickback voltage error between the lines 186 and 188 is approximately 0, as represented by the error amount 196 ($e_{0p}$). However, as the pixel voltage decreases, the kickback error between lines 186 and 188 progressively increases. For instance, at the minimum pixel voltage 190 (e.g., $V_D$ is at its minimum negative level), the kickback voltage error between the lines 186 and 188 is shown by reference number 194 ($e_{0n}$). As discussed above, two $V_{COM}$ lines may serve as stimulus and sense lines in a touchscreen. For instance, in the present example, line 186 may represent the kickback voltage of a stimulus line, and line 188 may represent the kickback voltage of a sense line.

Figure 11:
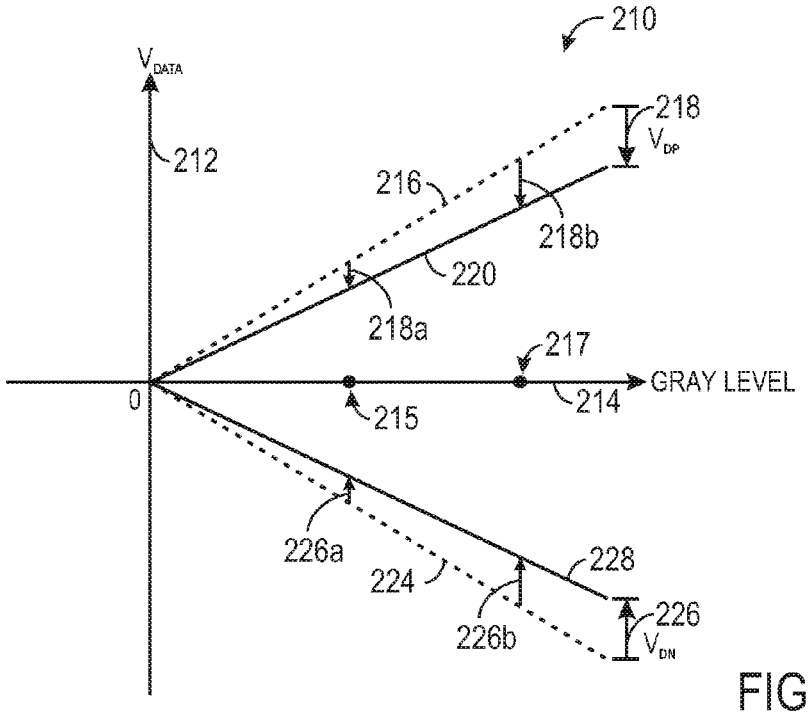
FIG. 11 is a graph illustrating data voltage offsets determined as a function of gray levels and which may be applied to the data voltage supplied to the second pixel of FIG. 8 to reduce the kickback voltage error shown in FIG. 9, in accordance with aspects of the present disclosure.
Figure 12:
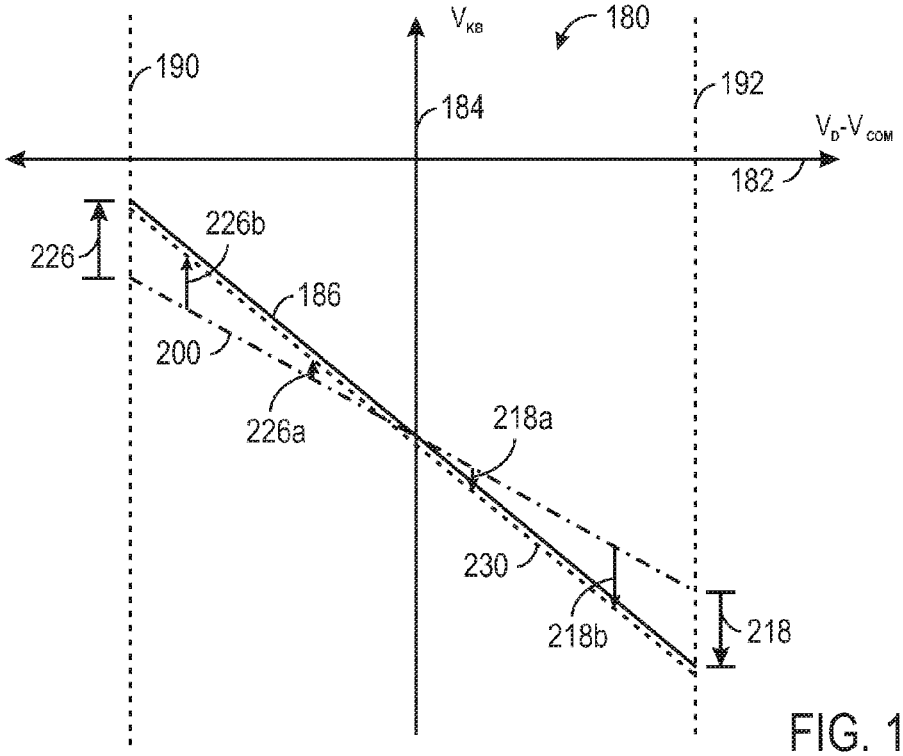
FIG. 12 is a graph showing the application of the common voltage offset, as depicted in FIG. 10, to the second common voltage of FIG. 8 and the application of the data voltage offset, as depicted in FIG. 11, to the data voltage supplied to the second pixel of FIG. 8 to reduce the kickback voltage error shown in FIG. 9, in accordance with aspects of the present disclosure.

As discussed above, the error in the kickback voltage between $V_{COM1}$ and $V_{COM2}$ may undesirably cause visual artifacts and/or reduce color accuracy in the display panel. Accordingly, embodiments of the present technique aim to reduce and compensate for such errors. One such technique for compensating for the kickback voltage error may include applying a first offset to $V_{COM2}$ and a second offset to the data voltage (e.g., $V_{D2}$) associated with the pixel (e.g., 82*h*) coupled to $V_{COM2}$. In one embodiment, the data voltage offset may be determined based on gray levels of the corresponding image data. This technique is illustrated by FIGS. 10-12, which are described below.

Figure 10:
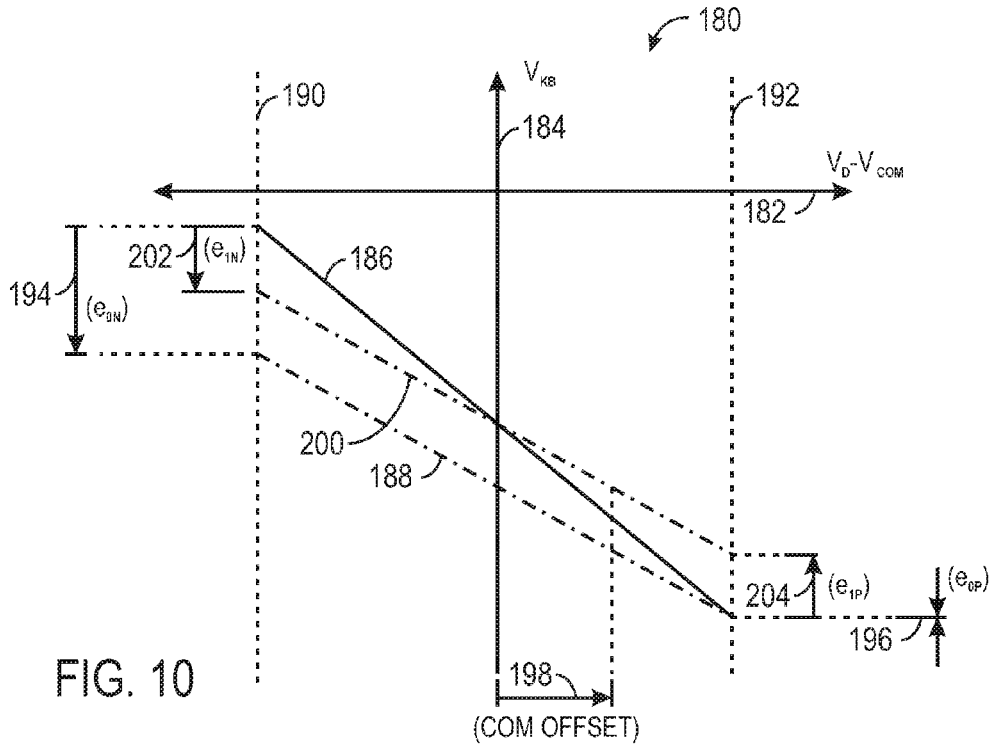
FIG. 10 is a graph illustrating a common voltage offset that may be applied to the second common voltage of FIG. 8 to reduce the kickback voltage error shown in FIG. 9, in accordance with aspects of the present disclosure.

FIG. 10 shows how an offset may be applied to $V_{COM2}$. As shown, the line 200 represents the line 188 shifted to the right by the offset amount 198. In the present embodiment, the offset 198 may be determined such that, when applied, the magnitude of the kickback voltage error of the shifted line 200 with respect to the line 186 is approximately equal at the maximum pixel voltage value 192 and the minimum pixel voltage value 190. For instance, as shown in FIG. 10, the kickback voltage error 204 ($e_{1p}$) at the maximum pixel voltage 192 and the kickback voltage error 202 ($e_{1n}$) at the minimum pixel voltage 190 is approximately equal in magnitude, but with opposite polarities.

The line 200 may be further shifted by applying an offset to the data voltage $V_{D2}$ of FIG. 8. In one embodiment, the data voltage offset may be determined based upon the gray level of the image data supplied to pixel 82*h* (e.g., digital data input 146). Referring now to FIG. 11, a graph depicting offsets that may be applied to the data voltage associated with $V_{COM2}$ is illustrated. As shown, the data voltage lines 216 and 224 represent the data voltage for $V_{D2}$ that may be supplied by the gamma circuitry 122 of FIG. 8. Particularly, the line 216 represents the positive data voltages and the line 224 represents negative data voltages (e.g., when the panel 80 is driven using an inversion driving technique).

The line 220 represents the offsets 218 that may be applied to the positive $V_{D2}$ values represented by the line 216, and the line 226 represents the offsets 226 that may be applied to the negative $V_{D2}$ values represented by the line 224. As shown, the amount of the offsets 218 and 226 generally increases in magnitude as the gray level represented by the digital image data (e.g., digital data input 146 of FIG. 8) increases. For example, when the gray level of the data input 146 has a value represented by reference number 215, a negative offset 218*a* may be applied when the data voltage $V_{D2}$ is being driven positively, and a positive offset 226*a* may be applied when the data voltage $V_{D2}$ is being driven negatively. Similarly, when the gray level of the data input 146 has a value represented by reference number 217 that is greater than the gray level 215, a negative offset 218*b* may be applied when the data voltage $V_{D2}$ is being driven positively, and a positive offset 226*b* may be applied when the data voltage $V_{D2}$ is being driven negatively, wherein the data offsets 218*b* and 226*b* are greater in magnitude relative to the data offsets 218*a* and 226*a*.

FIG. 12 illustrates the graph from FIG. 10, but with the data offsets discussed in FIG. 11 applied. As shown, the offsets 218 and 226 have been applied to the line 200 (which already reflects the common voltage offset 198 applied in FIG. 10) to generate the shifted line 230. Essentially, the application of the data offsets 218 and 226 (e.g., depending on whether $V_{D2}$ is being driven positive or negative) causes the line 200 to become slightly rotated in the clockwise direction about the axis 184, to produce the line 230. Although the lines 230 and 186 are shown in FIG. 12 as being slightly offset for purposes of clarity, it should be understood that the lines 230 and 186 may actually overlay one another or be collinear, thus substantially eliminating the kickback voltage error (e.g., error 194) between $V_{COM1}$ and $V_{COM2}$. As discussed above, by compensating for the kickback voltage error between $V_{COM1}$ and $V_{COM2}$ using the techniques described herein, the appearance of visual artifacts may be reduced and the color accuracy of the display panel 80 may be improved.

Figure 13:
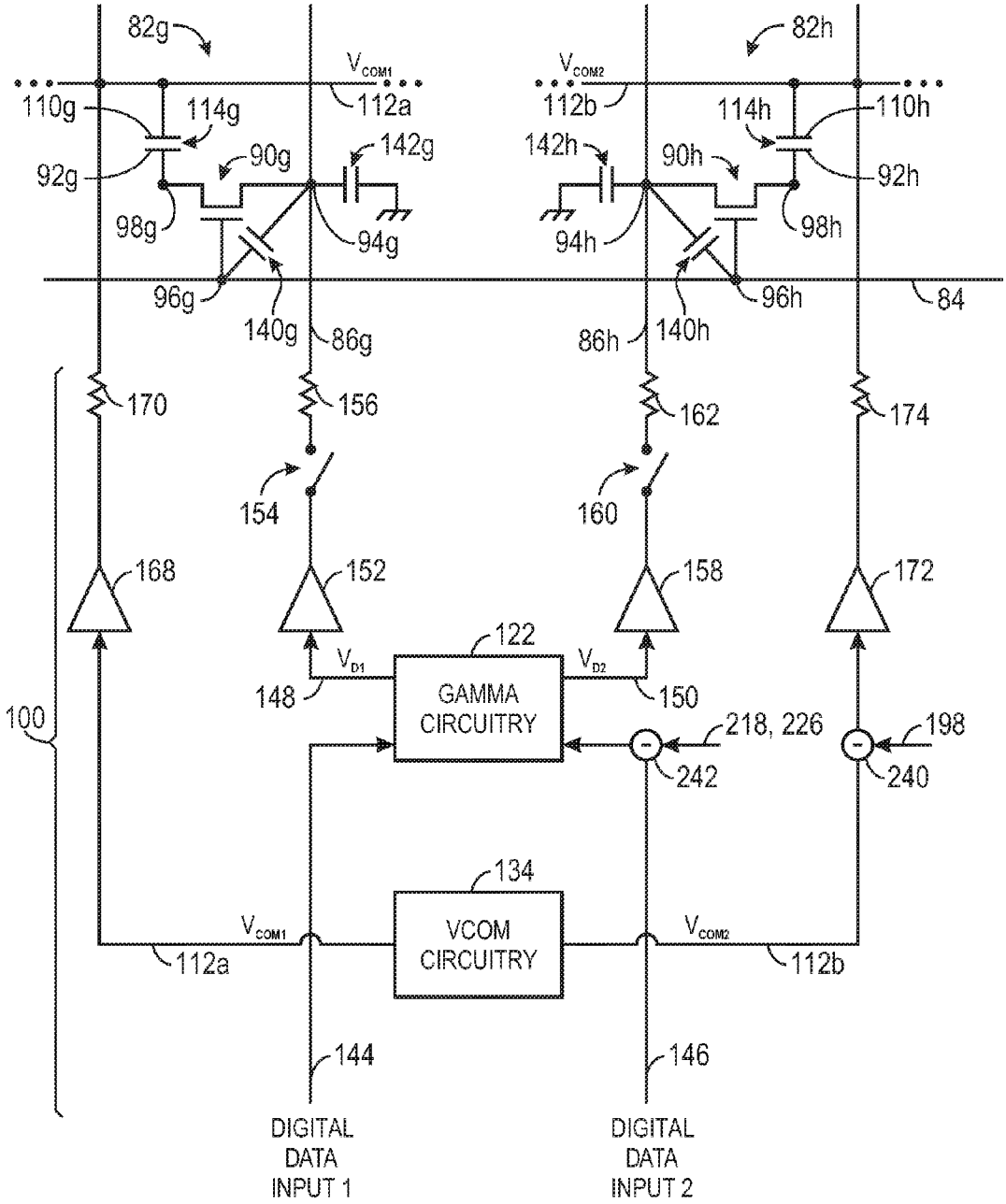
FIG. 13 shows the schematic representation of the source driver IC and first and second pixels of FIG. 8, but with logic configured to apply the common voltage offset of FIG. 10 to the second common voltage and the data voltage offset of FIG. 11 to the data voltage supplied to the second pixel, in accordance with aspects of the present disclosure.

Referring now to FIG. 13, the display circuitry including the source driver IC 100 and the pixels 82*g* and 82*h* shown in FIG. 8 is illustrated, but with additional logic in the source driver 100 configured to provide the kickback voltage error compensation techniques discussed above. In the present embodiment, the $V_{COM2}$ line 112*b* includes summation logic 240, which is configured to offset $V_{COM2}$ by the offset 198 depicted in FIG. 10 above. Further, summation logic 242 is provided between the gamma circuitry 122 and the digital data input 146. The summation logic 242 is configured to provide a data offset (e.g., 218, 226) to the digital input signal 146 based upon the data voltage offsets illustrated in FIG. 11. Moreover, while the present embodiment shows a digital offset being applied to the digital input signal 146 to obtain the desired data voltage offsets, other embodiments may apply the data offset to the analog data signal 150 instead. For instance, in such embodiments, the summation logic 242 may be located between the amplifier 158 and the gamma voltage circuitry 122.

In another embodiment, rather than using the summation logic 242, different gamma voltage circuits 122 may be used for converting the digital inputs 144 and 146 to the appropriate analog signals. For instance, a first gamma voltage circuit may be provided for converting the digital input 144 to an analog voltage signal may be configured to convert gray levels to analog voltage data based upon the non-offset curves 216 and 224 of FIG. 12, while another gamma voltage circuit 122 for converting the digital input 146 to an analog signal may be configured to convert gray levels to analog voltage data based upon the offset curves 220 and 228 of FIG. 12. In other words, the data the data voltage offset may be applied by using a separate gamma circuit configured to take the data offsets (e.g., 218, 226) into account when converting gray levels into the analog data voltage 150.

Figure 14:
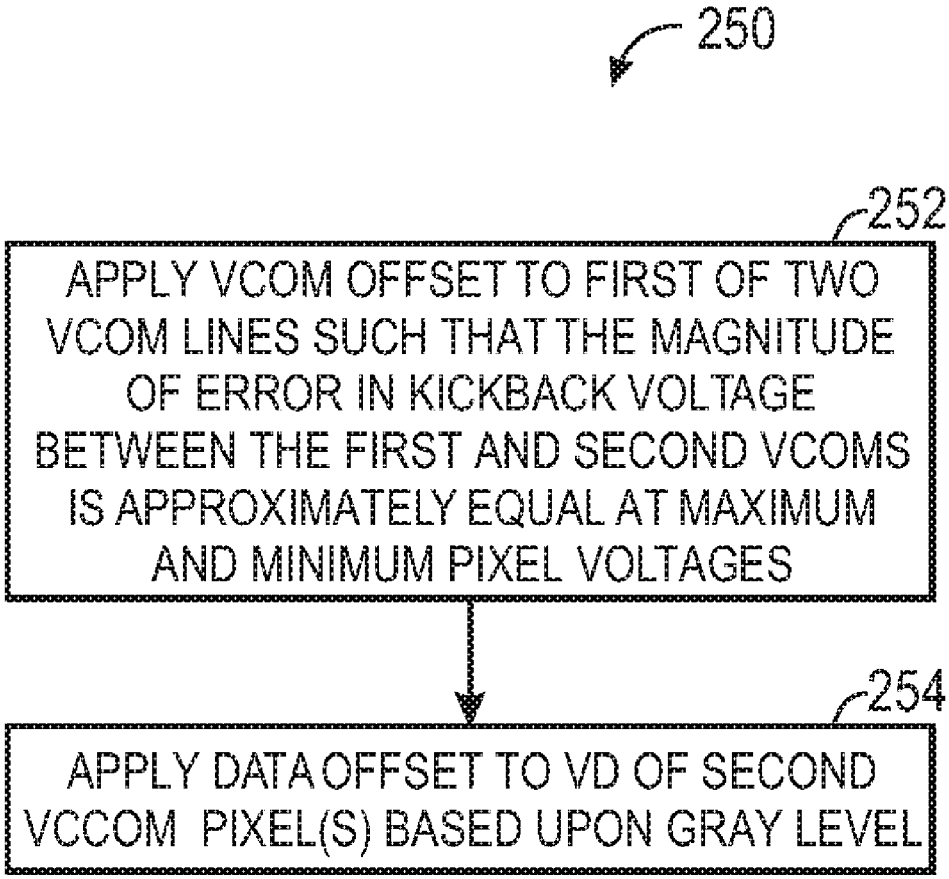
FIG. 14 is a flow chart depicting a method for performing kickback voltage error compensation between pixels coupled to different common voltage lines, in accordance with aspects of the present disclosure.

FIG. 14 is a flowchart depicting a method 250 for reducing the kickback voltage error between two $V_{COM}$ signals in a display device in accordance with the techniques disclosed herein. At block 252, an offset (e.g., 198) is applied to the first (e.g., $V_{COM2}$) of two common voltage lines such that the magnitude of the kickback voltage error between the two common voltage lines is approximately equal at the maximum and minimum pixel voltage values (e.g., 190 and 192). Next, at block 254, a data offset may be applied to the data voltage supplied to one or more pixels coupled to $V_{COM2}$. As discussed above with reference to FIG. 11, the data offset may be determined based upon the gray level of the corresponding input image data (e.g., digital data input 146). Using the method 250, the kickback voltage error between the two common voltage lines may be substantially reduced, if not eliminated, as depicted in the graph of FIG. 12. This may reduce the appearance of visual artifacts and may further improve the color accuracy of the display device 12.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A system comprising:

a common voltage generation circuit configured to provide a first common voltage and a second common voltage;

a liquid crystal display (LCD) panel comprising a pixel array having a plurality of unit pixels comprising a first unit pixel coupled to the first common voltage and a second unit pixel coupled to the second common voltage, wherein the first unit pixel is configured to receive a first analog data voltage and the second unit pixel is configured to receive a second analog data voltage;

logic configured to apply a common voltage offset to the second common voltage; and logic configured to apply a data voltage offset that modifies the second analog data voltage supplied to the second unit pixel;

wherein applying the common voltage offset and the data voltage offset substantially reduces kickback voltage error between the first common voltage and the second common voltage, a source driver circuit coupled to the LCD panel by a plurality of source lines including a first source line coupled to the first unit pixel and a second source line coupled to the second unit pixel;

comprising gamma voltage circuitry configured to receive a first gray level signal and a second gray level signal, to convert the first gray level signal to the first analog voltage, and to convert the second gray level signal to the second analog voltage, wherein the first and second analog voltages are transmitted onto the first and second source lines, respectively;

wherein the logic configured to apply the data voltage offset applies the data voltage offset to the second gray level signal.

2. The system of claim 1, wherein the first common voltage and the second common voltage have different values.

3. The system of claim 1, wherein the data voltage offset is determined based upon a gray level corresponding to the second analog data voltage.

4. The system of claim 1, wherein the common voltage offset is applied such that kickback voltage errors at the maximum value of the difference between the second analog voltage and the second common voltage and at the minimum value of the difference between the second analog voltage and the second common voltage are approximately equal in magnitude.

5. A source driver integrated circuit (IC), comprising:

a common voltage generation circuit configured to provide a first common voltage and a second common voltage to a first common voltage line and a second common voltage line, respectively, coupled to a display panel;

a first source line coupled to a first unit pixel of the display panel, the first unit pixel being coupled to the first common voltage;

a second source line coupled to a second unit pixel of the display panel, the second unit pixel being coupled to the second common voltage;

a first input configured to receive a first digital data signal;

a second input configured to receive a second digital data signal;

gamma adjustment circuitry configured to produce a first analog voltage signal based on the first digital data signal and a second analog voltage based on the second digital data signal, wherein the first and second analog voltage signals are transmitted onto the first and second source lines, respectively;

logic configured to offset the second common voltage by a common voltage offset; and logic configured to offset the second digital data signal by a data voltage offset;

wherein applying the common voltage offset and the data voltage offset reduces a kickback voltage error between the first common voltage line and the second common voltage line wherein the data voltage offset is determined based upon a gray level represented by the second digital data signal.

6. The source driver IC of claim 5, wherein the magnitude of the data voltage offset increases as the gray level represented by the second digital data signal increases.

7. The source driver IC of claim 5, wherein the first and second unit pixels are driven using an inversion driving technique.

8. The source driver IC of claim 7, wherein the inversion driving techniques comprises at least one of column inversion, dot inversion, row inversion, or some combination thereof.

9. The source driver IC of claim 7, wherein a negative data voltage offset is applied if the second analog voltage is being driven positively, and wherein a positive data voltage offset is applied if the second analog voltage is being driven negatively.

10. A method comprising:

determining a common voltage offset in a display device having a first unit pixel coupled to a first common voltage and a first analog voltage and a second unit pixel coupled to a second common voltage and a second analog voltage;

applying the common voltage offset to the second common voltage;

determining a data voltage offset; and applying the data voltage offset to a digital data signal corresponding to the second unit pixel, wherein applying the common voltage offset and the data voltage offset reduces kickback voltage error between the first common voltage and the second common voltage wherein determining the data voltage offset comprises selecting a data voltage offset based upon a gray level value of the digital data signal corresponding to the second unit pixel, wherein the magnitude of the data voltage offset is proportional to the gray level value.

11. The method of claim 10, wherein determining the common voltage offset comprises selecting a common voltage offset that, when applied, causes kickback voltage error corresponding to the maximum and minimum values of the difference between the second analog voltage and the second common voltage to be approximately equal in magnitude.

12. The method of claim 10, comprising using a gamma adjustment circuit to determine the second analog voltage, wherein the second analog voltage corresponds to the digital data signal corresponding to the second unit pixel when modified by the data voltage offset.

13. The method of claim 12, comprising using the gamma adjustment circuit to supply the first analog voltage to the first unit pixel and the second analog voltage to the second unit pixel.

14. An electronic device, comprising:

one or more input structures;

a storage structure encoding one or more executable routines;

a processor capable of receiving inputs from the one or more input structures and of executing the one or more executable routines when loaded in a memory; and a display device configured to display an output of the processor, wherein the display device comprises:

a liquid crystal display panel comprising a plurality of unit pixels including a first unit pixel associated with a first common voltage and a second unit pixel associated with a second common voltage;

a source driver integrated circuit (IC) comprising:

a common voltage generation circuit configured to generate the first common voltage and the second common voltage;

a first input configured to receive a first digital data input;

a second input configured to receive a second digital data input;

logic configured to modify the second common voltage by a first offset;

logic configured to modify the second digital data input by a second offset; and gamma adjustment logic configured to output a first analog voltage corresponding to the first digital data input and a second analog voltage corresponding to the modified second digital data input;

wherein applying the second offset to the second digital data input and applying the first offset to the second common voltage reduces a kickback voltage error between the first common voltage and the second common voltage wherein the second offset is determined based upon a gray level represented by the second digital data input.

15. The electronic device of claim 14, wherein the source driver IC comprises a first source line coupled to the first unit pixel and a second source line coupled to the second unit pixel, wherein the first analog voltage is supplied to the first unit pixel via the first source line and the second analog voltage is supplied to the second unit pixel via the second source line.

16. The electronic device of claim 14, wherein the magnitude of the second offset is directly proportional to the magnitude of the gray level represented by the second digital data input.

17. The electronic device claim 14, wherein the first offset is applied such that kickback voltage errors at the maximum value of the difference between the second analog voltage and the second common voltage and at the minimum value of the difference between the second analog voltage and the second common voltage are approximately equal in magnitude.

18. The electronic device of claim 14, wherein the electronic device comprises a desktop computer, a laptop computer, a tablet computer, a digital media player, or a mobile telephone.

* * * * *